US008468965B2

(12) United States Patent
Kor et al.

(10) Patent No.: US 8,468,965 B2
(45) Date of Patent: Jun. 25, 2013

(54) FLOATING DOCK

(75) Inventors: Jim Kor, Winnipeg (CA); Tom Hopper, Oak Bluff (CA)

(73) Assignee: Seaco Marine Inc, Oak Bluff, MB (CA)

( * ) Notice: Subject to any disclaimer, the term of this patent is extended or adjusted under 35 U.S.C. 154(b) by 240 days.

(21) Appl. No.: 12/732,350

(22) Filed: Mar. 26, 2010

(65) Prior Publication Data

US 2010/0294190 A1 Nov. 25, 2010

Related U.S. Application Data

(60) Provisional application No. 61/180,900, filed on May 25, 2009, provisional application No. 61/236,357, filed on Aug. 24, 2009.

(51) Int. Cl.
*B63B 35/613* (2006.01)

(52) U.S. Cl.
USPC ..... 114/263

(58) Field of Classification Search
USPC ..... 114/218, 219, 263; 405/212, 215, 405/216, 218, 219
See application file for complete search history.

(56) References Cited

U.S. PATENT DOCUMENTS

| | | | | |
|---|---|---|---|---|
| 5,779,412 | A * | 7/1998 | Nagai et al. | 411/85 |
| 6,536,992 | B1 * | 3/2003 | Floe | 405/218 |
| 7,784,419 | B2 * | 8/2010 | Bigler et al. | 114/263 |
| 2010/0303538 | A1 * | 12/2010 | Kor et al. | 403/22 |

* cited by examiner

*Primary Examiner* — Edwin Swinehart
(74) *Attorney, Agent, or Firm* — Adrian D. Battison; Ade & Company Inc

(57) ABSTRACT

A floating dock is formed from a fabricated frame including a pair of longitudinal extruded side rails and a plurality of cross rails interconnecting the side rails to form a rigid generally rectangular structure arranged to receive buoyancy members for floating the frame on a body of water. A plurality of floor planks bridge the side rails for forming a floor surface on the frame to be supported above the water. The rails include grooves in each surface defining a fastener having a nut to be located in the groove and a co-operating male fastener for engaging into the nut. The outer surface fastens to a rail along the outer surface and the inner surface carries the ends of the floor planks and attaches to fastening brackets of corner members.

14 Claims, 5 Drawing Sheets

FLOATING DOCK

This application claims the benefit under 35 U.S.C. 119 from Provisional Application Ser. No. 61/180,900 filed May 25, 2009 and from Provisional Application Ser. No. 61/236,357 filed Aug. 24, 2009.

This application relates to a co-pending application filed on the same day as this application Ser. No. 12/732,342 and relating to the floating dock described herein.

This invention relates to fastener combination including a groove and a nut which is primarily designed for a floating dock but which can be used in other areas than the floating dock.

SUMMARY OF THE INVENTION

It is one object of the present invention to provide a floating dock which uses extruded side rails.

According to one aspect of the invention there is provided a floating dock comprising:

a fabricated frame including a pair of longitudinal side rails and a plurality of cross rails interconnecting the side rails to form a rigid generally rectangular structure;

the frame being arranged to receive one of more buoyancy members for floating the frame on a body of water;

a plurality of floor planks bridging the side rails for forming a floor surface on the frame to be supported above the water;

each of the side rails being formed of an extruded member;

wherein each of the side rails is generally rectangular in cross section with an outwardly facing upstanding surface, an inwardly facing upstanding surface, a top surface and a bottom surface and wherein each of the side rails includes a mounting groove formed into at least the top surface, bottom surface and outwardly facing upstanding surface;

each mounting groove being arranged to receive a nut of a fastening system for attachment to a male fastener.

Preferably the inwardly facing upstanding surface also includes at least one mounting groove.

Preferably the inwardly facing upstanding surface has two vertically spaced mounting grooves for attachment to connecting brackets.

Preferably the inwardly facing upstanding surface includes a channel for receiving ends of the floor planks.

Preferably the outwardly facing upstanding surface has a channel outwardly of the mounting groove within which an elongate member can be received and fastened to the rail by a plurality of fasteners at spaced positions along the rail.

Preferably the inwardly facing upstanding surface includes an upper receptacle for receiving ends of the floor planks and at least one lower mounting groove arranged to receive a nut of a fastening system for attachment to a male fastener of an attachment bracket.

Preferably each mounting groove has a mouth located at a surface of the mounting body and a receptacle portion behind the mouth, the receptacle portion being wider than the mouth so as to define two shoulders each on a respective side of the mouth; wherein there is provided a nut member having female threaded hole therein, the nut member being shaped and arranged to be located in the groove, the nut member having a width greater than the width of the mouth so as to define front bearing surfaces on each side of the hole for engaging the shoulders, the female threaded hole being located between the bearing surfaces and arranged in an operating position with the hole at right angles to the mouth; wherein there is provided a fastener member having a male thread thereon shaped and arranged to pass through the mouth and to engage the female threaded hole in the nut member so as to pull the bearing surfaces of the nut member against the shoulders; and wherein the nut member being shaped such that its width in a direction longitudinal of the female threaded hole is less than the width of the mouth so that the nut member can be inserted into the groove through the mouth with the hole at right angles to the operating position and can be rotated in the receptacle portion to turn the hole to the operating position.

Preferably the nut member includes a pair of elements each element being arranged along or adjacent a respective side edge of the nut member and arranged to engage with a respective element along a respective shoulder so as to resist outward movement of the shoulders.

Preferably one of the elements comprises a rib and the other a groove.

According to a second aspect of the invention there is provided a floating dock comprising:

a fabricated frame including a pair of longitudinal side rails and a plurality of cross rails interconnecting the side rails to form a rigid generally rectangular structure;

the frame being arranged to receive one of more buoyancy members for floating the frame on a body of water;

a plurality of floor planks for forming a floor surface on the frame to be supported above the water;

each of the side rails being formed of an extruded member;

wherein each of the side rails is generally rectangular in cross section with an outwardly facing upstanding surface, an inwardly facing upstanding surface, a top surface and a bottom surface; and wherein the inwardly facing upstanding surface includes an upper receptacle for receiving ends of the floor planks and at least one lower mounting groove arranged to receive a nut of a fastening system for attachment to a male fastener of an attachment bracket.

Preferably the inwardly facing upstanding surface has two vertically spaced mounting grooves.

Preferably the outwardly facing upstanding surface has a channel outwardly of the mounting groove within which an elongate member can be received and fastened to the rail by a plurality of fasteners at spaced positions along the rail.

Preferably the upper receptacle for the floor planks is formed as a recess in the inwardly facing upstanding surface.

According to a third aspect of the invention there is provided a floating dock comprising:

a fabricated frame including a pair of longitudinal side rails and a plurality of cross rails interconnecting the side rails to form a rigid generally rectangular structure;

the frame being arranged to receive one of more buoyancy members for floating the frame on a body of water;

a plurality of floor planks for forming a floor surface on the frame to be supported above the water;

each of the side rails being formed of an extruded member;

wherein each of the side rails is generally rectangular in cross section with an outwardly facing upstanding surface, an inwardly facing upstanding surface, a top surface and a bottom surface;

wherein the outwardly facing upstanding surface includes at least one mounting groove for receiving a fastener therein; and wherein the outwardly facing upstanding surface has a channel outwardly of the mounting groove within which an elongate member can be received and fastened to the rail by a plurality of fasteners at spaced positions along the rail and engaging into the mounting groove.

Preferably the channel is recessed inwardly from the outwardly facing upstanding surface.

Preferably the channel includes upper and lower receptacles defined by edge flanges at the outwardly facing upstanding surface.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
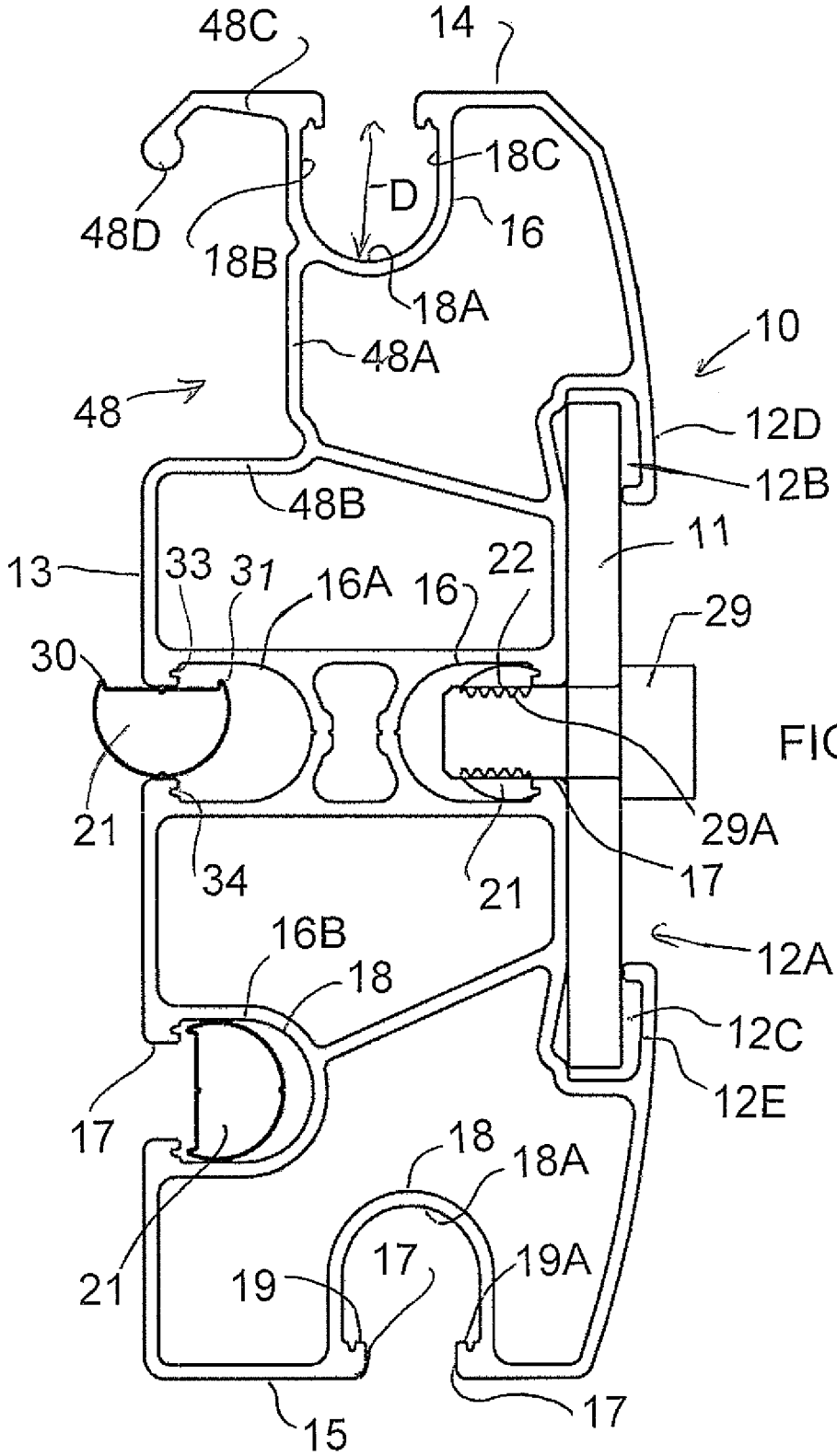
FIG. 1 is an end elevational view of an extruded rail showing a fastener combination according to the present invention including the insertion of a nut at one groove and the connection of the fastener to the inserted nut at another one of the grooves.
Figure 2:
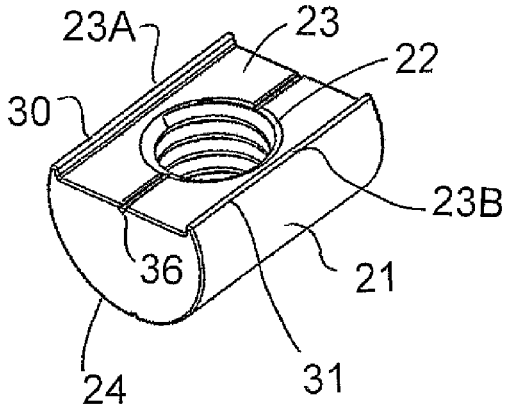
FIGS. 2, 3 and 4 show various views of the nut for insertion into the grooves of the extruded rail of FIG. 1.
Figure 3:
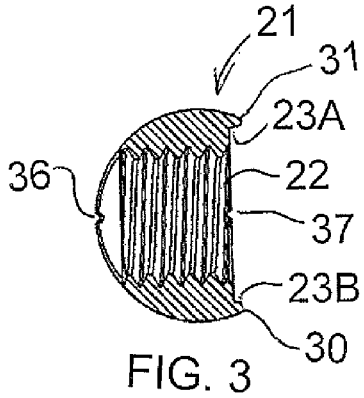

Turning firstly to FIG. 1, this shows a fastener combination comprising a mounting body 10 to which an element 11 is to be fastened. The mounting body 10 is an extruded profile which is generally rectangular in cross section with an outwardly facing upstanding surface 12, an inwardly facing upstanding surface 13, a top surface 14 and a bottom surface 15. The surfaces 14 and 15 are horizontal and the surface 13 is substantially at right angles and vertical. The surface 12 is slightly domed so that its center line extends outwardly from the top and bottom edges.

Each of the top surface, bottom surface and outwardly facing upstanding surface of the extrusion 10 includes a mounting groove or receptacle 16 formed into the surface and recessed inwardly therefrom. The inwardly facing upstanding surface 13 has two vertically spaced mounting grooves 16A and 16B.

Each of the grooves has a mouth 17 located at a surface of the mounting body and a receptacle portion 18 behind the mouth, the receptacle portion being wider 18 than the mouth 17 so as to define two shoulders 19 and 19A each on a respective side of the mouth.

A nut member 21 has a female threaded hole 22 therein. The nut member 21 has a flat front surface 23 and a semi-cylindrical rear surface 24. The hole 22 is located at the center of the flat front face 23 and at right angles to it.

The nut 21 is shaped and arranged to be located in the groove 16 so that the nut member has a width W greater than the width of the mouth 17 so as to define front bearing surfaces 23A and 23B on each side of the hole 22 for engaging the shoulders 19 and 20. The female threaded hole 22 is located between the bearing surfaces 23A and 23B and arranged in an operating position with the hole at right angles to the mouth.

The nut member has the bearing surfaces 23A and 23B thereof along substantially the full length thereof so as to bear against the shoulders 19 and 20 of the groove with an adequate bearing surface so that the nut member becomes a structural part of the groove.

A fastener member 29 has a male thread 29A thereon shaped and arranged to pass through the mouth 17 and to engage the female threaded hole 22 in the nut member 21 so as to pull the bearing surfaces 23A and 23B of the nut member 21 against the shoulders 19A and 19B. The nut member is shaped such that its width W1 in a direction longitudinal of the female threaded hole 22 is less than the width W of the mouth so that the nut member can be inserted into the groove 16 through the mouth 17 with the hole 22 at right angles to the operating position and can be rotated in the receptacle portion to turn the hole to the operating position.

The groove 16 has a base 18A of the receptacle portion 18 opposite the mouth 17 which is smoothly curved which matches the curvature of the rear surface 24 of the nut 21 opposite the bearing surfaces both of which are smoothly curved and preferably semi-cylindrical.

The groove 16 is substantially continuous along the mounting body as it is formed as an extrusion of constant cross section. However other forming techniques may be used so that the groove is not wholly continuous. However the nut member 21 is short in relation to the mounting body so that it can be inserted into the mouth at any point along the groove 16.

Figure 5:
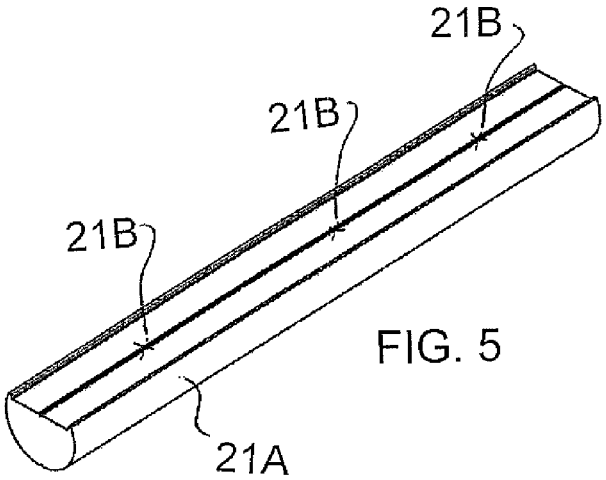
FIG. 5 shows an isometric view of a modified nut for insertion into the grooves of the extruded rail of FIG. 1.
Figure 4:
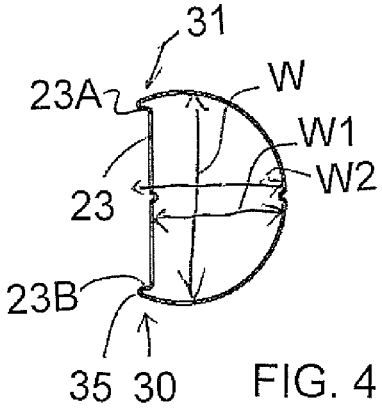

The length of the nut is such that it provides sufficient surface contact to allow transfer of the required fastening loads. However double or triple length or more nuts 21A can be used as shown in FIG. 5 which have a plurality of the threaded holes which can be drilled through the longer nut at spaced positions 21B therealong each for receiving a respective one of a plurality of male threaded fastener members. It will be appreciated that no matter the length of the nut it can be readily inserted into the groove at the required location through the mouth rather than from one end.

Preferably the mounting member 10 and the grooves 16 therein are extruded and cut to length and also the nut 21, 21A is similarly extruded and cut to length with the holes 22 drilled in a second action.

The shape of the recessed portion 18 is such that it has sides 18B and 18C which are substantially tangential to the semi-cylindrical base 18A so that the depth D of the groove is greater than the width W1 of the nut 21 giving some clearance behind the nut 21 when it is pulled forwardly to butt the shoulders 19 and 19A. Thus the width W1 of the nut member in the direction longitudinal of the hole 22 is sufficiently short to provide leeway for a cap screw to go right through the nut 21 with clearance behind the semi-circular surface 24.

The nut also includes two male ribs 30 and 31 running along the full length of the flat face 23 of the nut and arranged along the respective side edges or bearing surfaces 23A and 23B of the flat face 23. These male ribs 30 and 31 nest into two matching female grooves 33 and 34 at the shoulders 19 and 19A of the related extruded groove on the extrusion 10.

These two nesting ribs and grooves are not essential to the operation but when provided serve essentially two purposes. They are:

a) The interlocking ribs 30, 31 on the nut and the grooves 33, 34 on the extruded groove 16 strengthen the connection between the nut and extruded groove, essentially locking the two together, when the connection is made and the nut tightened. The extruded groove is weak at its open mouth 17 where the bolt passes through so that the front walls 19 and 19A can easily open further by the mouth 17 spreading apart with applied loads on the extrusion 10 greater than an intended maximum. This is because the semi-circular bottom part 18 of the extruded groove 16 can flex when over-loaded. Tightening the nut 21, in an arrangement without the ribs 30, 31, can causes friction between the nut 21 and extruded groove 16, and this helps by resisting opening of the groove 16 further under load. However, at large enough loads, this clamping force will allow the extruded groove 16 to open up potentially allowing the nut 21 to escape. For this reason, the mating ribs 30, 31 and grooves 33, 34 are added in some cases where higher loads are to be expected. With the ribs and grooves engaged, no opening up of the extruded groove 16 at the mouth 17 is possible. Material would have to shear in order for any relative movement to occur, while without the ribs ad grooves, parts need only to slide for relative movement to occur. The nut 21 and groove 16 are now locked together, not just held together by friction. This is important where increased loads are applied on the extrusion, for whatever reason. This design feature makes the assembled extrusion magnitudes stronger, where required, than it is without the ribs and grooves.

b) The mating ribs and grooves between the nut and extrusion are tapered. That is the side edges of the ribs converge to an upper apex 35. The outer side edge of the rib is contiguous with the outer cylindrical face of the nut and the inner side edge commences at the flat face 23 and converges toward the outer side edge to the smoothly curved apex. This is for two reasons. First, the taper makes sure that the nut always nests properly in the extruded groove. In other words, it does not get hung up. The taper allows the raised male ribs on the face of the nut to always find their way into the female grooves located on the inside face of the extruded groove. This is very important, as the assembler of the system has no way of making sure this will happen. The nut is just slipped into the groove, rotated, and tightened. It must, on its own, find the nested position, and the tapers allow for this to occur. The second reason for the tapers is that it allows the nut to essentially grab the extruded groove during tightening, and then continue to hold on once the assembly is loosened and disassembled. This is a convenience factor. It may be convenient to leave the nuts in position within the groove, as this would speed up reassembly. When required, a light tap on the nut would loosen it from the grooves, and allow it to fall loosely to the bottom of the extruded groove, and be extracted.

The nut, even with the addition of the two male ribs, still can enter the extruded groove from the outside, anywhere along the groove. Entry is accomplished by first putting in one male rib 30, 31 into the extruded groove 16, then rotating the nut 21 slightly to allow entry of the other male rib 30, 31. Without the male ribs, the nut just enters the groove 16 by sliding straight through sideways. Once within the extruded groove, the nut can rotate. The outside of the male ribs added to the nut maintains the circle diameter of the nut, so rotation within the extruded groove is unaffected by the addition of the male ribs. Thus the width W2 from the outside surface 18 of the nut 21 to the plane containing the apexes 60 is thus slightly larger than the width of the mouth 17.

In addition, the nut has two grooves 36 and 37: one centered on the flat face and the other centered on the semicircular back side. These grooves 36 and 37 facilitate holes being drilled in the required centered location, and from either side. Typically the nut 21 is supplied as a blank which are then made in various lengths and the appropriate threaded holes put in place a second process. The blanks can either be extruded aluminum lengths or forged stainless steel lengths. Either way, threaded holes are machined in later, and then the blanks cut to length. Lengths may have one or more threaded holes in them. One typical example is a cleat length which attaches a cleat to the extruded groove 16, and has two threaded holes that match the cleat's spacing. This makes attachment of the cleat more convenient than individual nuts.

Figure 6:
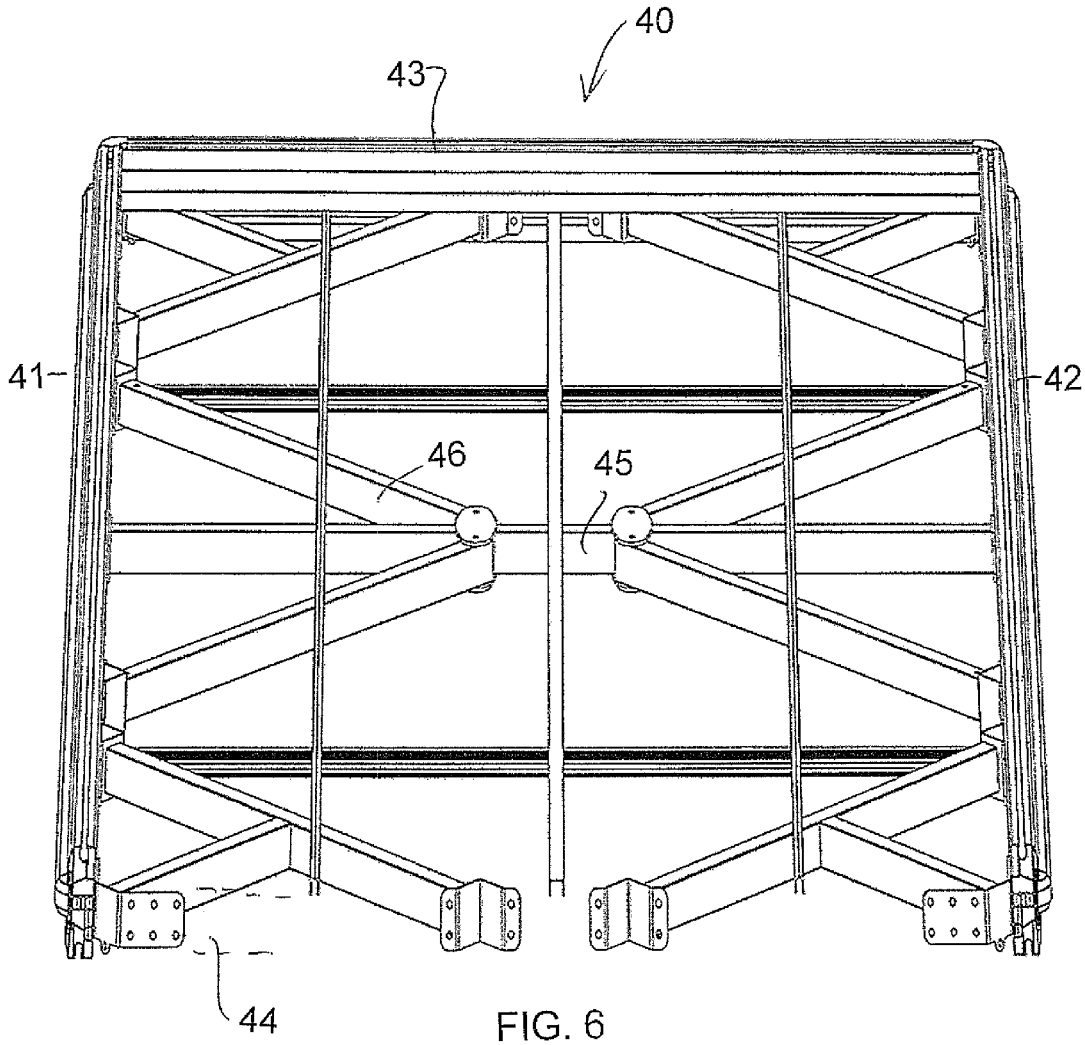
FIG. 6 is a perspective view of a frame for a floating dock including the fastening combination according to the present invention.
Figure 7:
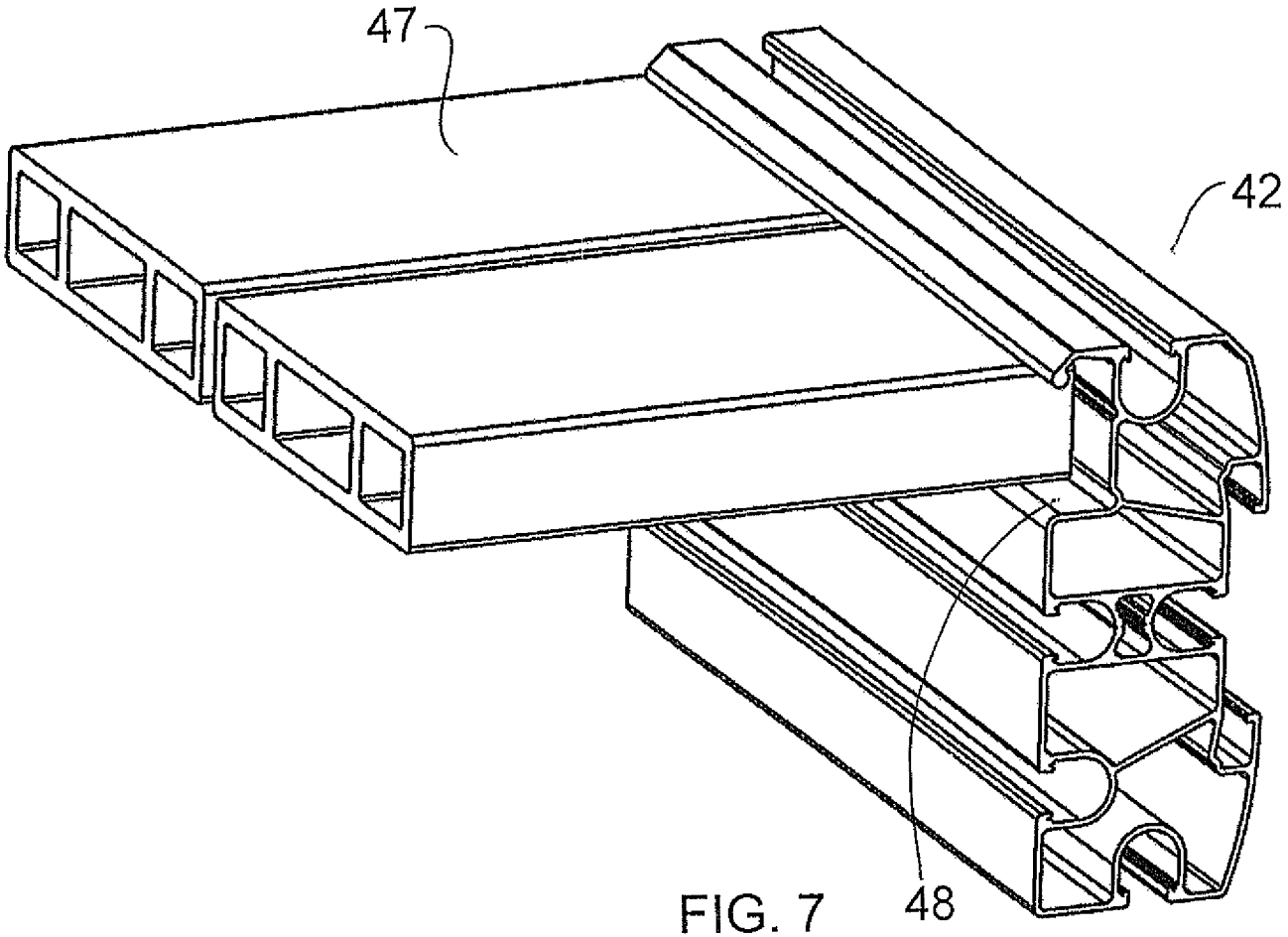
FIG. 7 is an isometric view of the extruded rail of one part only of the frame of FIG. 6 showing the fastening of floor planks to the extrusion.
Figure 8:
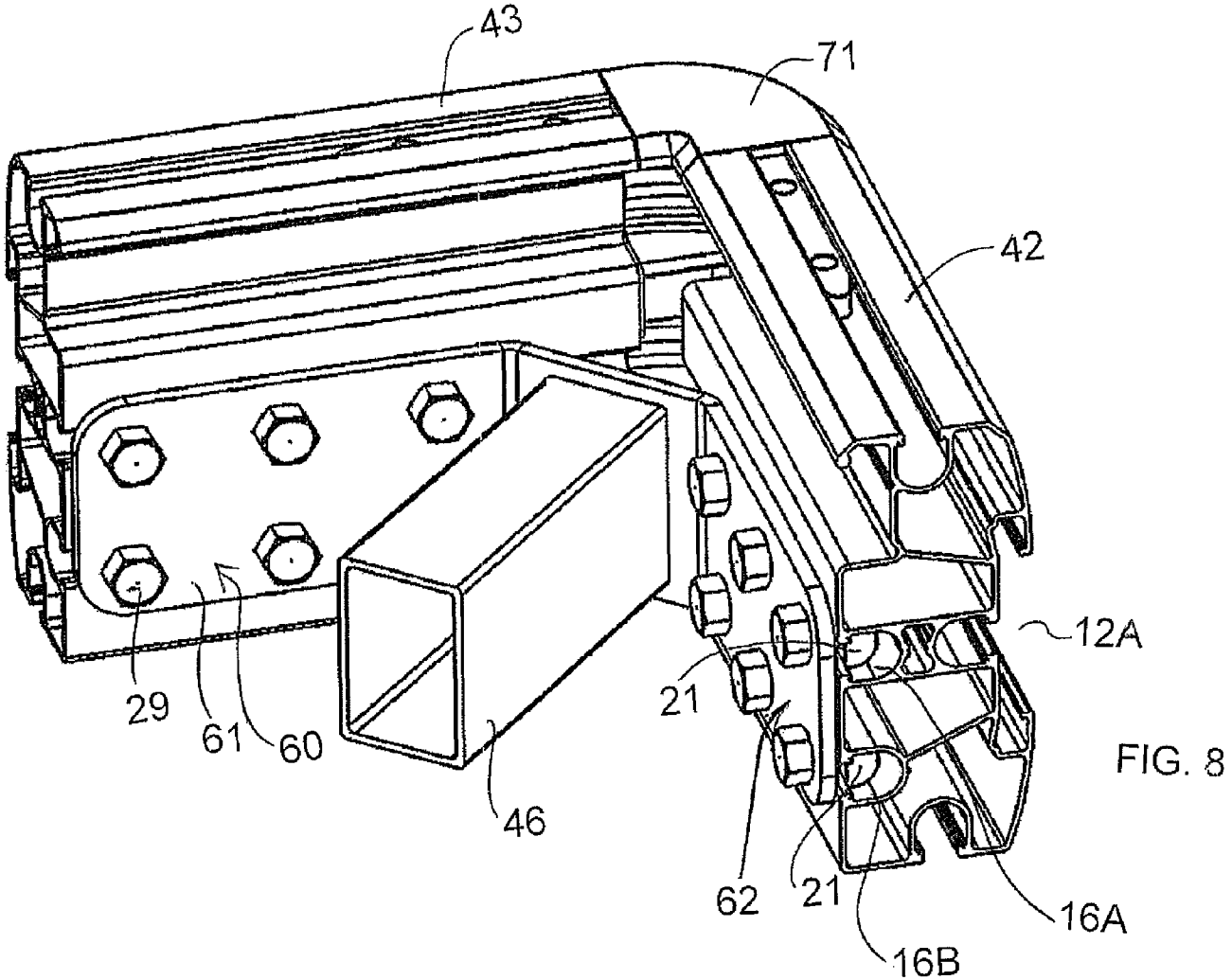
FIG. 8 is an isometric view of the extruded rails of one a corner only of the frame of FIG. 6 showing the fastening of the rails at the corner.

The fastener system described above can be used in many different constructions but is particularly designed for use in the floating dock shown in FIGS. 6, 7 and 8. This includes a fabricated frame 40 including a pair of longitudinal side rails 41 and 42 and a pair of end rails 43 and 44 all of which are formed of the cross-sectional shape shown in FIG. 1. These rails are connected at corners as shown in FIG. 8 to form a rigid generally rectangular structure. A plurality of cross rails 45 are provided interconnecting the side rails 41, 42 and braces 46 are provided as stiffening members. The frame is arranged to receive one of more buoyancy members (not shown) underneath the frame for floating the frame on a body of water.

A plurality of floor planks 47 form a floor surface on the frame to be supported above the water. The floor planks 47 are received into a channel 48 formed in the rear surface of the profile 10 as shown in FIG. 1. The channel 48 is located at the upper wall 14 so as to define a rear wall 48A of the recess, a bottom wall 48B and a top wall 48C which extends as a flange from the top wall 14. The space between the bottom wall 48B and a lip 48D at the front edge of the flange or top wall 48C is equal to the thickness of the floor boards 47.

The outwardly facing upstanding surface 12 has a channel 12A outwardly of the mounting groove 16 therein within which an elongate member 11 can be received and fastened to the rail by a plurality of fasteners 29 at spaced positions along the rail using the fastening system described above in the grooves 16. This can form a bumper or other fastener for the rail. The channel 12A is recessed inwardly from the outwardly facing upstanding surface 12 and includes upper and lower receptacles 12B and 12C defined by edge flanges 12D and 12E at the outwardly facing upstanding surface.

The grooves 16 in the top and bottom surfaces 14, 15 can be used to fasten various elements including dock rails, mounting points for boats and other items well known to a person skilled in this art.

The grooves 16A and 16B are used as shown in FIG. 8 for attachment to brackets 60 at the ends of the braces 46. Thus the bracket 60 includes two legs 61 and 62 each of which includes two rows of fasteners 29 which engage into nuts 21 located within the grooves 16A and 16B in the manner previously described, which are sufficiently long to engage all three fasteners 29 in the groove 16A, 16B. In addition FIG. 8 shows a corner cover 71 which is a cast corner piece which has an end piece bridging the extrusions at the corner and including insert legs which are a tight fit into the ends of the extrusions 42, 43 to close off the corner.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A floating dock comprising:

a fabricated frame including a pair of longitudinal side rails and a plurality of cross rails interconnecting the side rails to form a rigid generally rectangular structure;

the frame being arranged to receive one of more buoyancy members for floating the frame on a body of water;

a plurality of floor planks for forming a floor surface on the frame to be supported above the water;

each of the side rails being formed of an extruded member;

wherein each of the side rails is generally rectangular in cross section with an outwardly facing upstanding surface, an inwardly facing upstanding surface, a top surface and a bottom surface;

wherein the outwardly facing upstanding surface of each respective one of the side rails has a channel within which an elongate member can be received and fastened to the respective one of the side rails by a plurality of fasteners at spaced positions along the respective one of the side rails;

wherein the outwardly facing upstanding surface includes a mounting groove within the channel for receiving said plurality of fasteners which engage into the mounting groove at spaced positions along the length thereof.

2. The floating dock according to claim 1 wherein the channel includes upper and lower receptacles defined by edge flanges at the outwardly facing upstanding surface.

3. The floating dock according to claim 1 wherein each of the side rails includes in the top surface and bottom surface a respective mounting groove arranged to receive a nut of a fastening system for attachment to a male fastener.

4. The floating dock according to claim 3 wherein the inwardly facing upstanding surface also includes at least one mounting groove.

5. The floating dock according to claim 3 wherein the inwardly facing upstanding surface has two vertically spaced mounting grooves for attachment to connecting brackets.

6. The floating dock according to claim 3 wherein the inwardly facing upstanding surface includes a channel for receiving ends of the floor planks.

7. The floating dock according to claim 3 wherein the inwardly facing upstanding surface includes an upper receptacle for receiving ends of the floor planks and at least one lower mounting groove arranged to receive a nut of a fastening system for attachment to a male fastener of an attachment bracket.

8. The floating dock according to claim 1 wherein each of the mounting grooves has a mouth located in the respective surface of the side rail and a receptacle portion behind the mouth, the receptacle portion being wider in a direction transverse to the longitudinal direction than the mouth so as to define two shoulders of the front wall each on a respective side of the mouth;

wherein each fastener comprises a nut member having a female threaded hole therein, the nut member being shaped and arranged to be located in the respective groove;

each nut member having a width in the direction transverse to the longitudinal direction greater than the width of the mouth so as to define two front bearing surfaces on a front surface of the nut member each on a respective side of the hole for engaging a respective one of the shoulders, the female threaded hole being located between the bearing surfaces and arranged in an operating position of the nut member with an axis of the hole at a right angle to the front wall of the mounting body containing the mouth;

and wherein each fastener comprises a fastener member having a male thread thereon shaped and arranged to pass through the mouth and to engage the female threaded hole in the nut member so as to pull the bearing surfaces of the nut member against the shoulders;

each nut member being shaped such that it has a width in a direction longitudinal of the axis of the female threaded hole which is less than the width of the mouth so that the nut member can be inserted into the groove through the mouth with the nut member turned around an axis parallel to the longitudinal direction through ninety degrees from its operating position so that the axis of the female threaded hole is parallel to the front face of the front surface of the mounting body and so that the nut member can be rotated in the receptacle portion around the axis parallel to the longitudinal direction through ninety degrees to turn the female threaded hole back to the operating position of the nut member;

each receptacle portion having a base opposite the mouth which is smoothly curved about an axis parallel to the longitudinal direction;

each nut member having a rear face which faces the base of the receptacle portion in the operating position of the nut member which is smoothly curved about an axis parallel to the longitudinal direction and which matches the smooth curvature of the base of the receptacle;

each receptacle portion having two each sides extending from the base to the front wall at a respective one of the shoulders which are parallel and substantially tangential to the base;

wherein a depth of each groove from the front wall to the base is greater than a width of the respective nut member between the front surface and the rear surface of the nut member in a direction at a right angle to the front surface.

9. The floating dock according to claim 8 wherein the base of each groove and the rear surface of the respective nut member are both semi-cylindrical.

10. The floating dock according to claim 8 wherein each nut member includes a pair of elements each element being arranged along or adjacent a respective side edge of the front face of the nut member and arranged to engage with a respective element along a respective one of the shoulders so as to resist outward movement of the shoulders.

11. The floating dock according to claim 10 wherein one of the elements comprises a rib and the other a groove.

12. The floating dock according to claim 11 wherein the element on the nut comprises a rib and the element on the shoulder comprises a groove.

13. The floating dock according to claim 12 wherein the rib and the groove each taper to an apex.

14. The floating dock according to claim 8 wherein the nut member includes a pair of grooves with one along a center line of the front face and the second along a center line of the rear face.

* * * * *